US011001967B1

(12) United States Patent
Coleman, Sr.

(10) Patent No.: US 11,001,967 B1
(45) Date of Patent: May 11, 2021

(54) PULP-DIGESTER SCREEN CLEANER

(71) Applicant: Farnsworth Coleman, Sr., Pine Mountain Valley, GA (US)

(72) Inventor: Farnsworth Coleman, Sr., Pine Mountain Valley, GA (US)

( * ) Notice: Subject to any disclaimer, the term of this patent is extended or adjusted under 35 U.S.C. 154(b) by 0 days.

(21) Appl. No.: 15/712,420

(22) Filed: Sep. 22, 2017

(51) Int. Cl.
*D21C 7/08* (2006.01)
*D21C 9/00* (2006.01)
*D21C 3/24* (2006.01)

(52) U.S. Cl.
CPC ..... *D21C 7/08* (2013.01); *D21C 9/008* (2013.01); *D21C 3/24* (2013.01)

(58) Field of Classification Search
CPC ... D21C 7/08; D21C 3/24; D21C 7/00; D21C 9/008
See application file for complete search history.

(56) References Cited

U.S. PATENT DOCUMENTS 3,589,521 A 6/1971 Richter
3,755,072 A * 8/1973 Ostberg ..... B01D 29/01 162/237
5,536,367 A * 7/1996 Salminen ..... D21C 3/24 162/17
5,736,005 A 4/1998 Flodquist

FOREIGN PATENT DOCUMENTS

JP 2007070773 A * 3/2007
WO WO-9424363 A1 * 10/1994 ..... B01D 21/18

* cited by examiner

*Primary Examiner* — Jose A Fortuna

(57) ABSTRACT

A pulp-digester screen cleaner having a pneumatic actuator with a cylinder and a rod coaxially disposed within the cylinder. An actuator mounting plate is used to mount the actuator outside of a pulp-digester screen housing pipe. A rod seal has a body disposed on the pipe that prevents any loss of fluid or pressure, yet allows the rod to pass into the pipe. The cylinder contains all of the mechanics of the pneumatic actuator and can be easily serviced without draining the digester. The rod is disposed through a first aperture of each of a pair of scrapers. A treated edge of each of the pair of scrapers varies to match different digester screen types and patterns. The present pulp-digester screen cleaner eliminates the need for chemical cleaning or other mechanical cleaning solutions. It will also improve pulp quality, increase pulp production, and promote overall digester efficiency.

1 Claim, 5 Drawing Sheets

PULP-DIGESTER SCREEN CLEANER

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

TO ALL WHOM IT MAY CONCERN

Be it known that I, Farnsworth Coleman, Sr., a citizen of the United States, have invented new and useful improvements in a pulp-digester screen cleaner as described in this specification.

BACKGROUND OF THE INVENTION

Paper production mills rely on constantly running, continuous pulp-digesters to produce pulp from wood chips, yet these vessels are prone to clog with calcium scale and precipitated lignin build up. The maintenance required to clean out the pulp-digesters screens and the missed opportunity cost from machine downtime, are extremely costly. Various types of pulp-digester cleaning apparatuses are known in the prior art. Chemical solutions are typical, yet have a high recurring cost, safety risks, chloride cracking of welds, and only provide a temporary solution. Existing mechanical solutions such as that presented by Salminen (U.S. Pat. No. 5,536,367) utilize a scraping apparatus, which does not apply to Kamyr continuous digesters, yet require a mechanism disposed within the pipe, disrupting flow and channeling. Such internal mechanisms are also costly and difficult to maintain, as they require the pulp-digester to be drained in order to be accessed. Other mechanical solutions make use of a motor and require a transmission, further adding to cost and complication. What is needed, and what the present pulp-digester screen cleaner provides, is a mechanical scraping solution that provides minimal interference to circulation flows and has all working components disposed outside of the vessel, providing for easy maintenance and eliminating the need for pulp-digester drainage for acid cleaning or hydra blasting.

FIELD OF THE INVENTION

The present invention relates to continuous pulp-digesters, and more particularly, to a pulp-digester screen cleaner that prevents scale build up.

SUMMARY OF THE INVENTION

The general purpose of the present pulp-digester screen cleaner, described subsequently in greater detail, is to provide a pulp-digester screen cleaner that has many novel features that result in a pulp-digester screen cleaner that is not anticipated, rendered obvious, suggested, or even implied by prior art, either alone or in combination thereof.

To accomplish this, the present pulp-digester screen cleaner includes a pneumatic actuator having a cylinder and a rod coaxially disposed within said cylinder. An actuator mounting plate is used to mount the actuator outside of the digester shell walls, and to secure the actuator in place as the rod moves. The rod is disposed through a third aperture of a mechanical pack box seal, and then through a fourth aperture in the pulp-digester shell. The seal prevents any loss of fluid or pressure, yet allows the rod to travel freely as driven by the actuator cylinder. The cylinder contains all of the mechanics of the pneumatic actuator, and, as it is disposed outside of the vessel, it can be easily serviced without draining the digester. The fourth aperture is disposed a distance from a liquor screen of the pulp-digester. The distance substantially conforms to a width of each of a pair of scrapers.

Each of the pair of scrapers has a length, a width, a top, a bottom, a straight edge, a treated edge, and a first aperture. The first aperture is medially disposed along the length proximal the straight edge, and the rod is disposed through the first aperture of each of the pair of scrapers. One of the pair of scrapers is disposed proximal an end of the rod. The treated edge of each of the pair of scrapers varies to match different digester screen types and patterns. As the pneumatic actuator drives the rod, the treated edges of the pair of metal scrapers are driven along the liquor screen to break and prevent blockages. The scrapers are further reinforced by a pair of scraper supports. Each of the pair of scraper supports has a second aperture and a pair of arms. The pair of arms of one of the pair of scraper supports is disposed on the top of one of the pair of scrapers, and the rod is disposed through the second aperture of each of the pair of scraper supports.

The pneumatic actuator has speed-regulating snubbers and a Programmable Logic Controlled linked to a digester pressure transmitter and a flushing system with a flowmeter, an automatic vale, and a pH sensor to control extracted liquor pH. The present pulp-digester screen cleaner eliminates the need for chemical cleaning or other mechanical cleaning solutions. It will also improve pulp quality, increase pulp production, reduce soda loss and promote overall digester efficiency.

Thus have been broadly outlined the more important features of the present pulp-digester screen cleaner so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
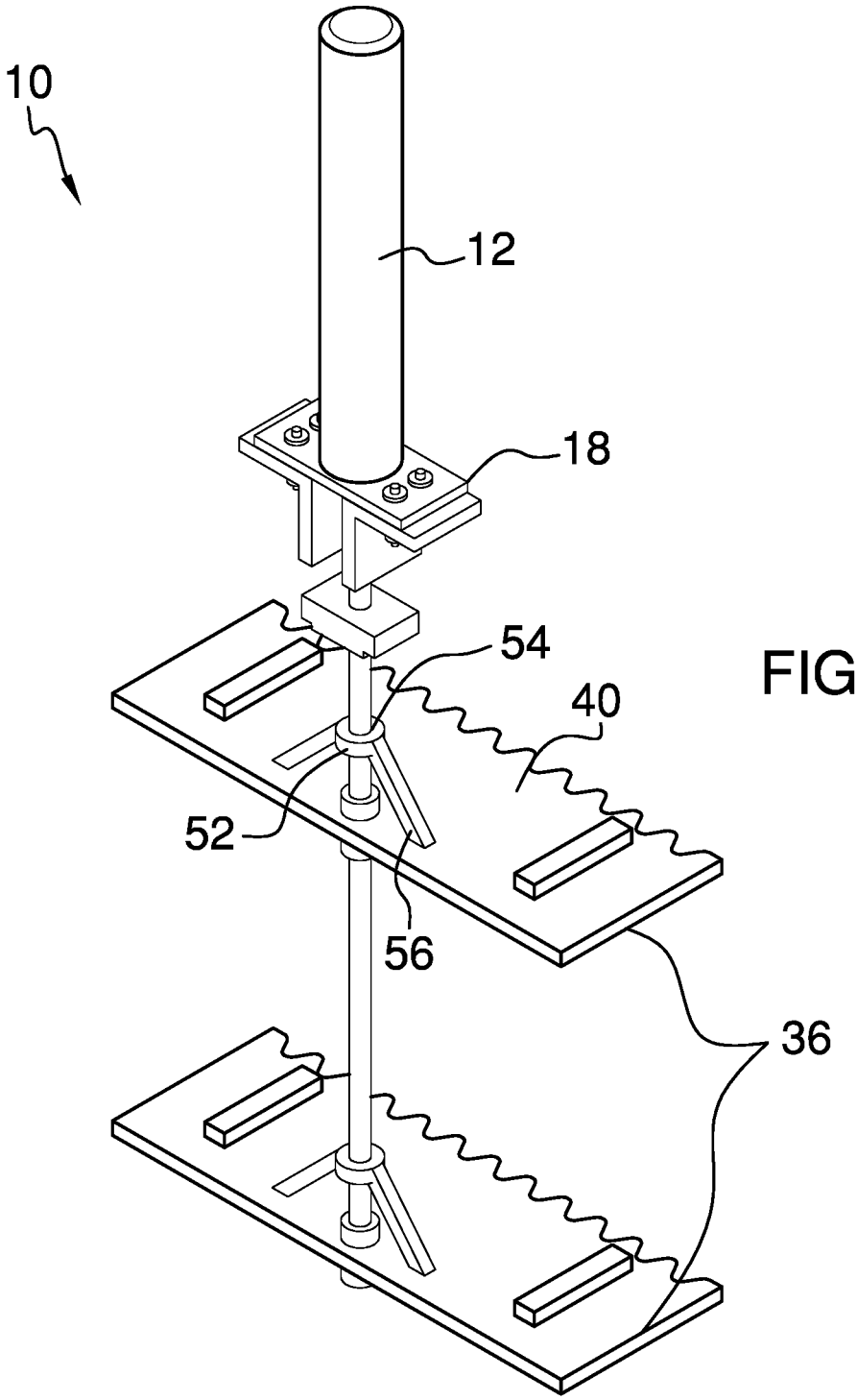
FIG. 1 is an isometric view of a pulp-digester screen cleaner.
Figure 2:
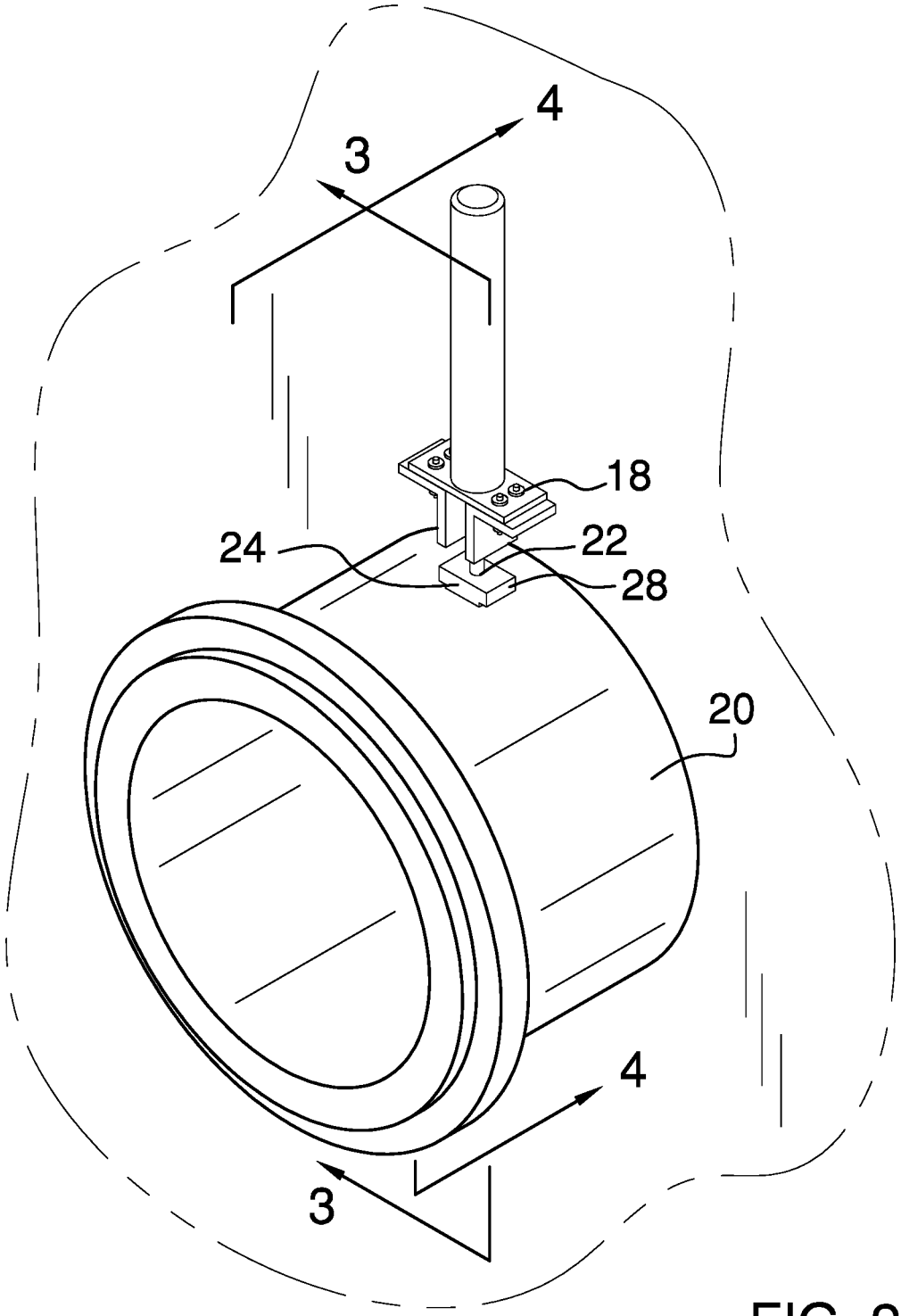
FIG. 2 is an isometric view of the pulp-digester screen cleaner installed on a pulp-digester screen housing pipe.
Figure 3:
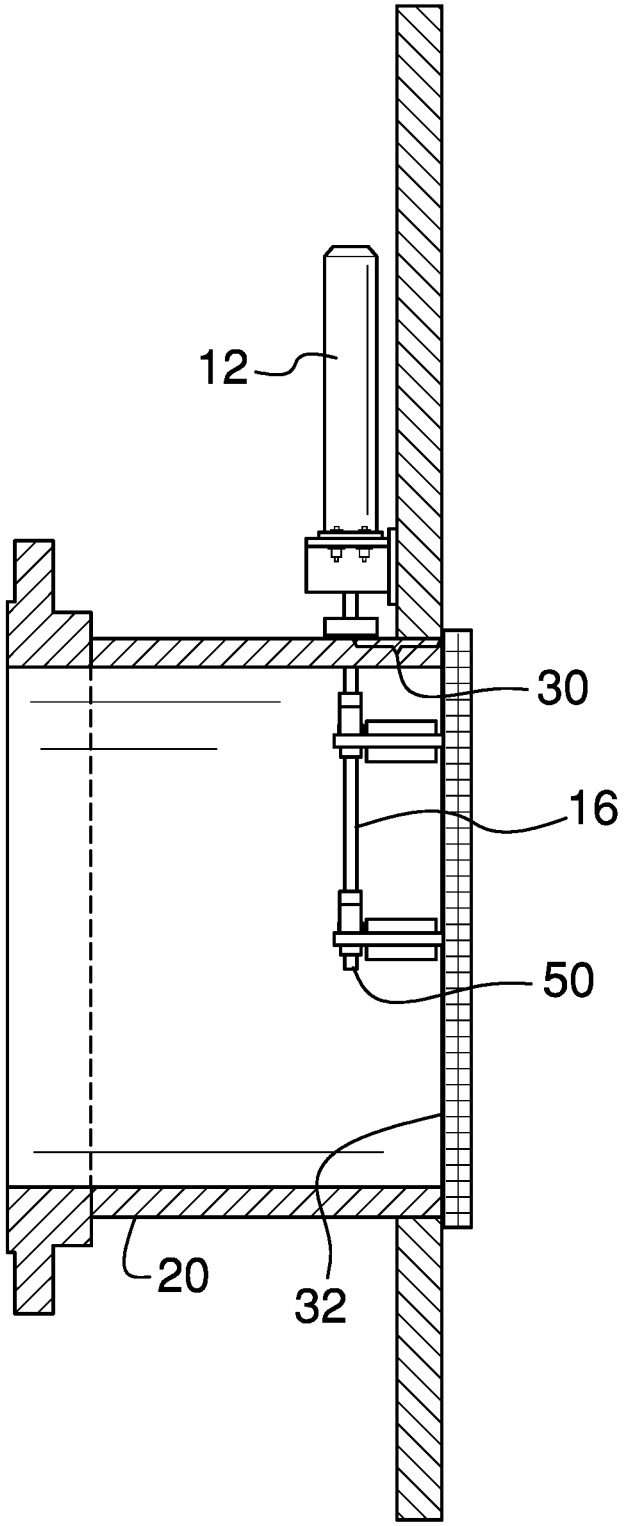
FIG. 3 is cross-sectional view of the pulp-digester screen cleaner along line 3-3 of FIG. 2.
Figure 4:
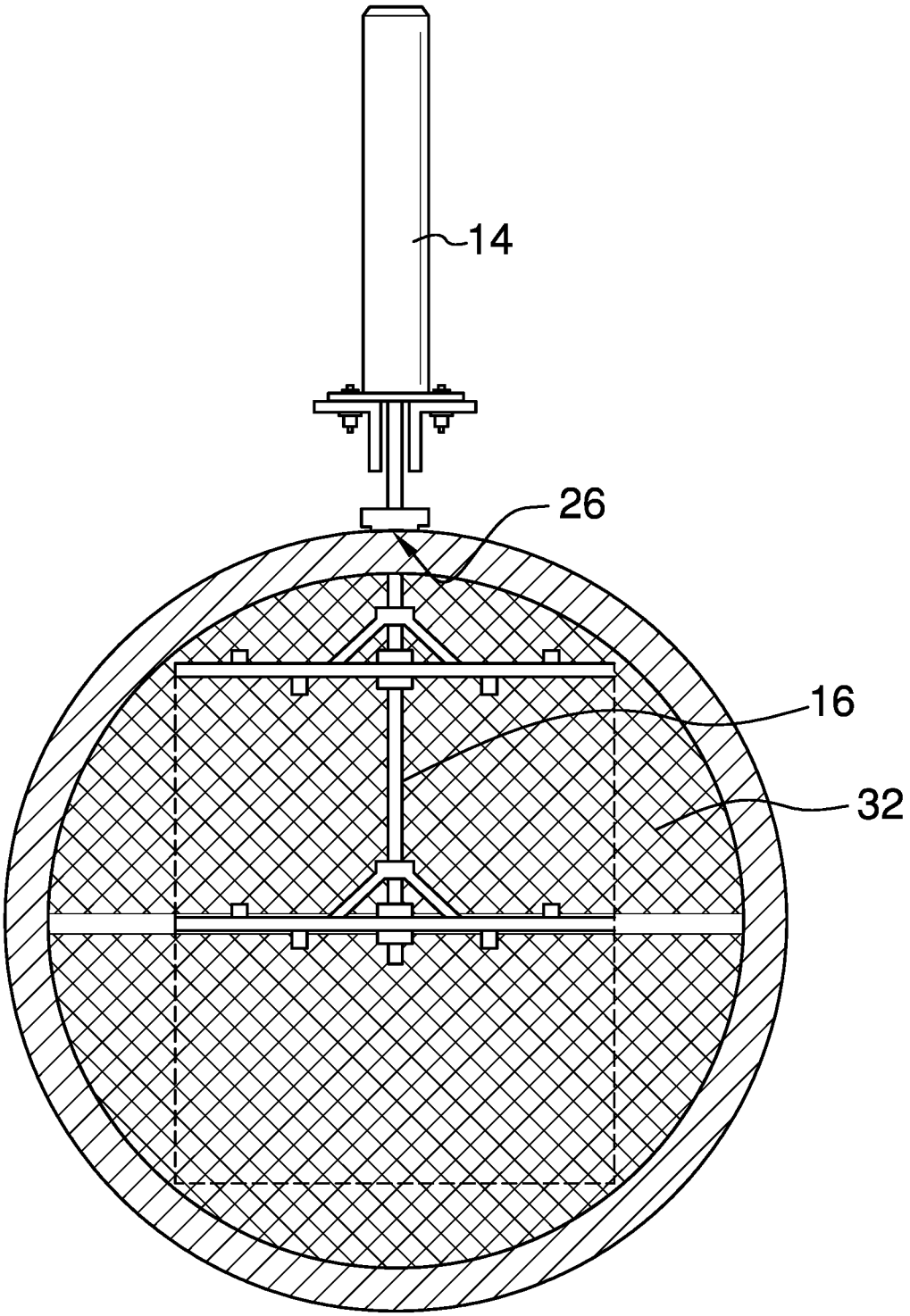
FIG. 4 is cross-sectional view of the pulp-digester screen cleaner along line 4-4 of FIG. 2.
Figure 5:
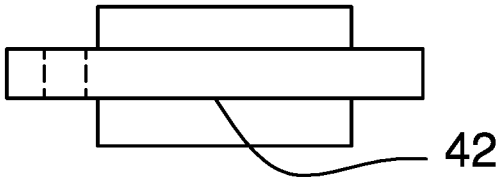
FIG. 5 is a side elevation view of a scraper.
Figure 6:
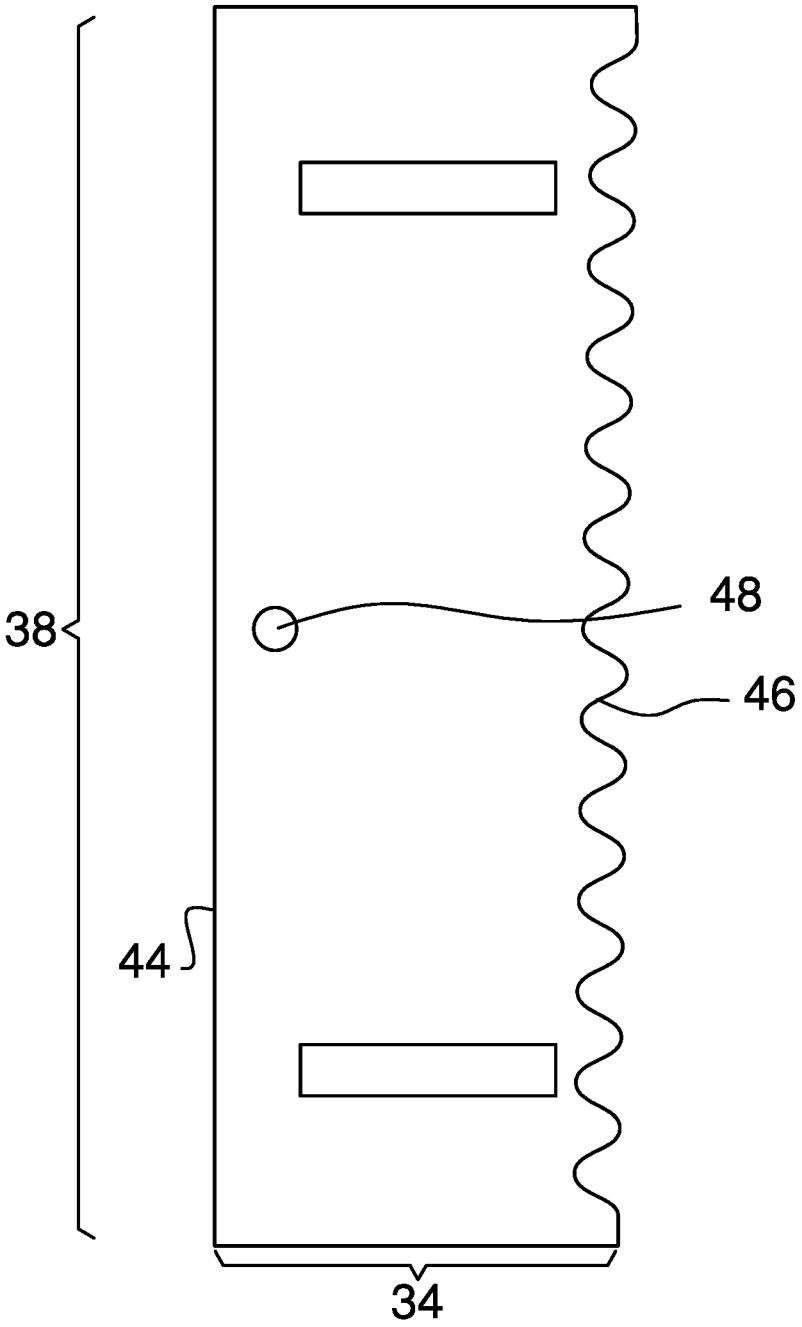
FIG. 6 is a top plan view of the scraper.

With reference now to the drawings, and in particular FIGS. 1 through 6 thereof, an example of the instant pulp-digester screen cleaner employing the principles and concepts of the present pulp-digester screen cleaner and generally designated by the reference number 10 will be described.

Referring to FIGS. 1 through 6 the present the pulp-digester screen cleaner 10 is illustrated. The pulp-digester screen cleaner 10 includes a pneumatic actuator 12 having a cylinder 14 and a rod 16 coaxially disposed within said cylinder. An actuator mounting plate 18 is used to mount the actuator outside of a pulp-digester screen housing pipe 20, and to secure the actuator in place as the rod moves. The rod is disposed through a third aperture 22 of a road seal 24, and then through a fourth aperture 26 in the pulp-digester pipe. The rod seal has a body 28 disposed on the pipe that prevents any loss of fluid or pressure, yet allows the rod to travel freely as driven by the cylinder. The fourth aperture is disposed a distance 30 from a liquor screen 32 of the pulp-digester. The distance substantially conforms to a width 34 of each of a pair of scrapers 36.

Each of the pair of scrapers has a length 38, the width 34, a top 40, a bottom 42, a straight edge 44, a treated edge 46, and a first aperture 48. The first aperture is medially disposed along the length proximal the straight edge, and the rod is disposed through the first aperture of each of the pair of scrapers. One of the pair of scrapers is disposed proximal an end 50 of the rod. The scrapers are further reinforced by a pair of scraper supports 52. Each of the pair of scraper supports has a second aperture 54 and a pair of arms 56. The pair of arms of one of the pair of scraper supports is disposed on the top of one of the pair of scrapers, and the rod is disposed through the second aperture of each of the pair of scraper supports.

What is claimed is:

1. A pulp-digester screen cleaner comprising:

a pneumatic actuator having a cylinder and a rod that is movable and coaxially disposed within said cylinder;

a pair of scrapers, wherein each of the pair of scrapers has a length, a width, a top, a bottom, a straight edge, a treated edge, and a first aperture, wherein the first aperture is medially disposed along the length proximal the straight edge, wherein the rod is disposed through the first aperture of each of the pair of scrapers, wherein one of the pair of scrapers is disposed proximal an end of the rod;

a pair of scraper supports, wherein each of the pair of scraper supports has a second aperture and a pair of arms, wherein the pair of arms of one of the pair of scraper supports is disposed on the top of one of the pair of scrapers, wherein the rod is disposed through the second aperture of each of the pair of scraper supports;

a rod seal having a body and a third aperture, wherein the rod is disposed through the third aperture, wherein the body is disposed on an outside of a fourth aperture, wherein the fourth aperture is disposed through a pipe of a pulp-digester, wherein the fourth aperture is disposed at a distance from a liquor screen of said pulp-digester, wherein the distance substantially conforms to the width of each of the pair of scrapers;

and an actuator mounting plate; wherein the actuator mounting plate is configured to secure the actuator in place as the rod moves.

* * * * *